US010123676B2

(12) United States Patent
Kramer

(10) Patent No.: US 10,123,676 B2
(45) Date of Patent: Nov. 13, 2018

(54) WAREWASH MACHINE WITH AUTOMATED DRAIN AND FILL

(71) Applicant: Steven H. Kramer, Osgood, OH (US)

(72) Inventor: Steven H. Kramer, Osgood, OH (US)

(73) Assignee: ILLINOIS TOOL WORKS INC., Glenview, IL (US)

( * ) Notice: Subject to any disclaimer, the term of this patent is extended or adjusted under 35 U.S.C. 154(b) by 442 days.

(21) Appl. No.: 14/870,733

(22) Filed: Sep. 30, 2015

(65) Prior Publication Data

US 2016/0100737 A1 Apr. 14, 2016

Related U.S. Application Data

(60) Provisional application No. 62/062,394, filed on Oct. 10, 2014.

(51) Int. Cl.

| | |
|---|---|
| ***A47L 15/24*** | (2006.01) |
| ***A47L 15/42*** | (2006.01) |
| ***A47L 15/00*** | (2006.01) |

(52) U.S. Cl.

CPC ..... *A47L 15/241* (2013.01); *A47L 15/0031* (2013.01); *A47L 15/4223* (2013.01); *A47L 2301/04* (2013.01); *A47L 2301/08* (2013.01); *A47L 2401/04* (2013.01); *A47L 2401/20* (2013.01); *A47L 2501/01* (2013.01); *A47L 2501/02* (2013.01)

(58) Field of Classification Search

None

See application file for complete search history.

(56) References Cited

U.S. PATENT DOCUMENTS

| | | | |
|---|---|---|---|
| 203,745 | A | 5/1878 | Leverty |
| 1,327,708 | A | 1/1920 | Guy |
| 1,511,825 | A | 10/1924 | Burns |
| 1,717,229 | A | 6/1929 | Kraeft |
| 2,075,443 | A | 3/1937 | Kirschner et al. |
| 2,142,924 | A | 1/1939 | Stoddard |
| 2,241,940 | A | 5/1941 | Atkins et al. |
| 2,263,963 | A | 11/1941 | Barry |

(Continued)

FOREIGN PATENT DOCUMENTS

| | | | |
|---|---|---|---|
| CN | 201308421 | Y | 9/2006 |
| CN | 103120576 | A | 5/2013 |
| CN | 104042172 | A | 9/2014 |

OTHER PUBLICATIONS

PCT, International Search Report and Written Opinion, International Application No. PCT/US2015/053917; dated Nov. 25, 2015, 12 pages.

*Primary Examiner* — David G Cormier
*Assistant Examiner* — Jason P Riggleman
(74) *Attorney, Agent, or Firm* — Thompson Hine LLP

(57) ABSTRACT

A conveyor warewasher includes at least one spray zone with multiple nozzles for spraying liquid onto wares passing therethrough, the spray zone including a tank for collecting sprayed liquid. The tank includes a drain outlet at the bottom of the tank for draining of the tank and a drain stop movable between a drain outlet closed position and a drain outlet open position. A drain control assembly includes a drain actuator operatively connected to cause movement of the drain stop between the drain outlet closed position and the drain outlet open position, and the drain actuator is moved by a powered device.

6 Claims, 5 Drawing Sheets

(56) References Cited

U.S. PATENT DOCUMENTS

| | | | | |
|---|---|---|---|---|
| 2,279,619 | A | 4/1942 | Fisher | |
| 2,403,526 | A | 7/1946 | Harris | |
| 2,418,366 | A | 4/1947 | Powers | |
| 2,573,794 | A | 11/1951 | Kueneman | |
| 2,649,765 | A | 8/1953 | Anderson | |
| 2,669,240 | A | 2/1954 | Thorson | |
| 2,681,658 | A | 6/1954 | Meeker et al. | |
| 2,689,576 | A | 9/1954 | Colstad | |
| 2,722,225 | A | 11/1955 | Carson | |
| 2,842,161 | A | 7/1958 | Hunter et al. | |
| 2,907,335 | A | 10/1959 | Abresch | |
| 3,025,864 | A | 3/1962 | Ensign | |
| 3,174,489 | A | 3/1965 | Jellies et al. | |
| 3,217,884 | A | 11/1965 | Long | |
| 3,319,651 | A | 5/1967 | Ullman, Jr. et al. | |
| 3,464,437 | A | 9/1969 | Zane | |
| 3,903,909 | A | 9/1975 | Noren et al. | |
| 4,086,938 | A * | 5/1978 | Churley | A47L 15/0081 134/57 DL |
| 4,162,546 | A | 7/1979 | Shortell | |
| 4,182,351 | A | 1/1980 | Deaton et al. | |
| 4,347,861 | A | 9/1982 | Clearman et al. | |
| 4,612,947 | A | 9/1986 | Duncan | |
| 4,657,188 | A | 4/1987 | Crane et al. | |
| 5,236,137 | A | 8/1993 | Coogan | |
| 5,272,775 | A | 12/1993 | Walraven | |
| 5,676,319 | A | 10/1997 | Stiggins et al. | |
| 5,909,743 | A | 6/1999 | Thies et al. | |
| 5,937,879 | A * | 8/1999 | Payzant | A47L 15/4206 134/104.1 |
| 6,058,526 | A | 5/2000 | Parisi et al. | |
| 6,103,017 | A | 8/2000 | Thies et al. | |
| 6,138,692 | A | 10/2000 | Kobos et al. | |
| 6,276,000 | B1 | 8/2001 | Saman et al. | |
| 7,472,712 | B2 | 1/2009 | Ashton et al. | |
| 8,252,121 | B2 * | 8/2012 | Brunswick | A47L 15/241 134/111 |
| 8,377,226 | B2 | 2/2013 | Favaro et al. | |
| 2004/0073992 | A1 | 4/2004 | Saman et al. | |
| 2009/0241993 | A1 * | 10/2009 | Warner | A47L 15/241 134/10 |
| 2012/0298146 | A1 | 11/2012 | Padtberg et al. | |

* cited by examiner

WAREWASH MACHINE WITH AUTOMATED DRAIN AND FILL

CROSS-REFERENCES

This application claims the benefit of U.S. Provisional Application Ser. No. 62/062,394, filed Oct. 10, 2014, the entirety of which is incorporated herein by reference.

TECHNICAL FIELD

This application relates generally to warewash machines and, more specifically, to a conveyor warewasher with an automated draining operation.

BACKGROUND

Commercial warewashers of the conveyor-type (e.g., using a continuous conveyor with slots for wares or using a conveyor that reciprocates to moves wares through the machine in baskets) commonly include a housing area which defines washing and rinsing zones for dishes, pots pans and other wares. In certain zones, water is typically pumped from a tank through a pump intake, delivered to the wares via a spraying operation and then collected in the tank for re-use. In instances where the wash solution within a given tank becomes undesirably soiled, it may become necessary for the operator to manually drain the tank by lifting a drain lever to an open position until the wash solution drains out, then releasing the lever to refill the tank with water. This operation requires some time on the part of the operator, as the operator must remain in the vicinity of the tanks during the process.

It would be desirable to provide a more operator friendly machine, enabling the operator to perform other necessary functions during a drain and refill process.

SUMMARY

In one aspect, a conveyor warewasher includes at least one spray zone with multiple nozzles for spraying liquid onto wares passing therethrough, the spray zone including a tank for collecting sprayed liquid. The tank includes a drain outlet at the bottom of the tank for draining of the tank and a drain stop movable between a drain outlet closed position and a drain outlet open position. A drain control assembly includes a drain actuator operatively connected to cause movement of the drain stop between the drain outlet closed position and the drain outlet open position, and the drain actuator is moved by a powered device.

In one implementation of the above aspect, the powered device is a solenoid actuator operatively connected to move the drain actuator.

In one implementation of the above aspect, the powered device is a motor that rotates a cam member, which in turn engages the drain actuator.

In one implementation of the above aspect, the machine includes an interface button for use in triggering operation of the powered device. In one example, the machine includes a controller responsive to actuation of the interface button to activate the powered device to move the drain actuator to a position corresponding to the drain stop in the drain outlet open position for a predetermined time period and, after the predetermined time period to activate the powered device to move the drain actuator to a position corresponding to the drain stop in the drain outlet closed position.

In another aspect, a conveyor warewasher for washing wares includes a housing defining at least one spray zone for spraying liquid onto wares passing therethrough. A tank collects sprayed liquid, and includes a drain outlet. A drain stop is positioned in the tank and movable between a lowered drain outlet closed position and a raised drain outlet open position. The drain stop includes an upwardly extending overflow pipe through which excess liquid in the tank can flow to the drain outlet even when the drain stop is in the lowered drain outlet closed position. An automated drain control arrangement includes a drain actuator positioned to effect movement of the drain stop between the lowered drain outlet closed position and the raised drain outlet open position.

In one implementation of the foregoing aspect, the automated drain control arrangement includes a linear actuator positioned for engaging the drain actuator.

In one implementation of the foregoing aspect, the automated drain control arrangement include a rotatable cam member positioned for engaging the drain actuator during rotation.

In one example of the foregoing implementation, the automated drain control arrangement includes a motor operatively connected to rotate the cam member.

In one variation of the foregoing example, the automated drain control arrangement includes a controller operatively connected to effect operation of the motor, the controller configured to carry out a tank drain operation in which the cam member is rotated into a drain actuator lift position that causes the drain stop to move to the raised drain outlet open position.

In one instance of the foregoing variation, during the tank drain operation the controller is configured to control the motor so as to maintain the cam member in the drain actuator lift position for a set time period, and to thereafter control the motor to move the cam member to a drain actuator drop position that enables the drain stop to move to the lowered drain outlet closed position.

In one implementation of the foregoing aspect, the automated drain control arrangement includes a controller operatively connected to effect movement of the drain actuator, the controller configured to carry out a tank drain operation in which the drain stop is moved to the raised drain outlet open position.

In one example of the foregoing implementation, during the tank drain operation the controller is configured to maintain the drain stop in the raised drain outlet position for a set time period, and to thereafter effect movement of the drain stop to the lowered drain outlet closed position.

In one variation of the foregoing example, the controller is configured to effect refill of the tank after the drain stop has been moved to the lowered drain outlet closed position.

In one variation of the foregoing example, the controller is configured to initiate the tank drain operation in response to operator actuation of an interface button.

In one variation of the foregoing example, the controller is operatively connected to effect movement of the drain actuator through one of (i) a motor and rotatable cam member or (ii) a solenoid operated linear actuator.

The details of one or more embodiments are set forth in the accompanying drawings and the description below. Other features, objects, and advantages will be apparent from the description and drawings, and from the claims.

DETAILED DESCRIPTION

Figure 1:
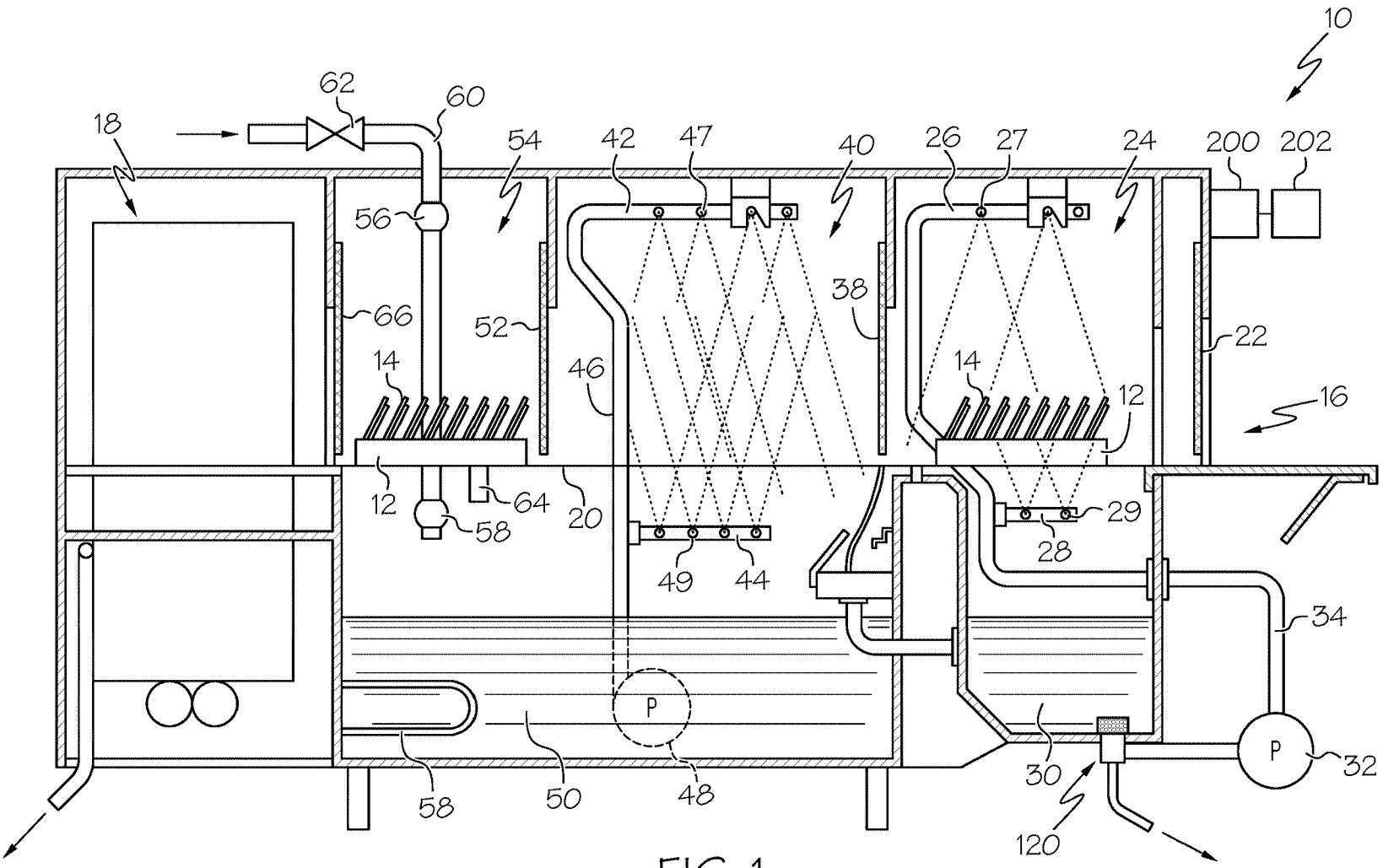
FIG. 1 (PRIOR ART)
FIG. 1 is a schematic depiction of one embodiment of a conveyor warewasher.

Referring to FIG. 1, an exemplary conveyor-type warewash system, generally designated 10, is shown. Warewash system 10 can receive racks 12 of soiled wares 14 from an input side 16 which are moved through tunnel-like chambers from the input side toward a dryer unit 18 at an opposite end of the warewash system by a suitable conveyor mechanism 20. Either continuously or intermittently moving conveyor mechanisms or combinations thereof may be used, depending, for example, on the style, model and size of the warewash system 10. The conveyor machine includes multiple spray zones for cleaning the wares passing therethrough. In the illustrated embodiment, the racks 12 of soiled wares 14 enter the warewash system 10 through a flexible curtain 22 into a pre-wash chamber or zone 24 where sprays of liquid from upper and lower pre-wash manifolds 26 and 28 with spray nozzles 27 and 29, above and below the racks respectively, function to flush heavier soil from the wares. The liquid for this purpose comes from a tank 30 via a pump 32 and supply conduit 34. As will be described below, a drain system 120 provides a single location where liquid is pumped from the tank 30 using the pump 32 and where liquid can be drained from the tank, for example, for a tank cleaning operation.

The racks proceed to a next curtain 38 into a main wash chamber or zone 40, where the wares are subject to sprays of cleansing liquid from upper and lower wash manifolds 42 and 44 with spray nozzles 47 and 49, respectively, these sprays being supplied through a supply conduit 46 by a pump 48, which draws from a main tank 50. A heater 58, such as an electrical immersion heater provided with suitable thermostatic controls (not shown), maintains the temperature of the cleansing liquid in the tank 50 at a suitable level. Not shown, but which may be included, is a device for adding a cleansing detergent to the liquid in tank 50. During normal operation, pumps 32 and 48 are continuously driven, usually by separate motors, once the warewash system 10 is started for a period of time.

The warewash system 10 may optionally include a power rinse chamber or zone (not shown in FIG. 1) that is substantially identical to main wash chamber 40. In such an instance, racks of wares proceed from the wash chamber 40 into the power rinse chamber, within which heated rinse water is sprayed onto the wares from upper and lower manifolds.

The racks 12 of wares 14 exit the main wash chamber 40 through a curtain 52 into a final rinse chamber or zone 54. The final rinse chamber 54 is provided with upper and lower spray heads 56, 58 (with respective nozzles) that are supplied with a flow of fresh hot water via pipe 60 under the control of solenoid valve 62. A rack detector 64 is actuated when a rack 12 of wares 14 is positioned in the final rinse chamber 54 and through suitable electrical controls, the detector causes actuation of the solenoid valve 62 to open and admit the hot rinse water to the spray heads 56, 58. The water then drains from the wares into tank 50. The rinsed rack 12 of wares 14 then exit the final rinse chamber 54 through curtain 66, moving into dryer unit 18, and eventually out of the machine.

A machine controller 200 and user interface 202 are shown schematically in FIG. 1. The term controller as used herein is intended to broadly encompass any circuit (e.g., solid state, application specific integrated circuit (ASIC), an electronic circuit, a combinational logic circuit, a field programmable gate array (FPGA)), processor (e.g., shared, dedicated, or group—including hardware or software that executes code) or other component, or a combination of some or all of the above, that carries out the control functions of the machine or the control functions of any component thereof. The user interface 202 may, by way of example, be a touch screen display (e.g. capable of presenting user actuatable buttons), a regular display in combination with one or more keys or buttons, a set of buttons and one or more indicator lights, or combinations of any of the foregoing.

Many variations of conveyor warewash devices are possible, the foregoing being merely one example.

Figure 2:
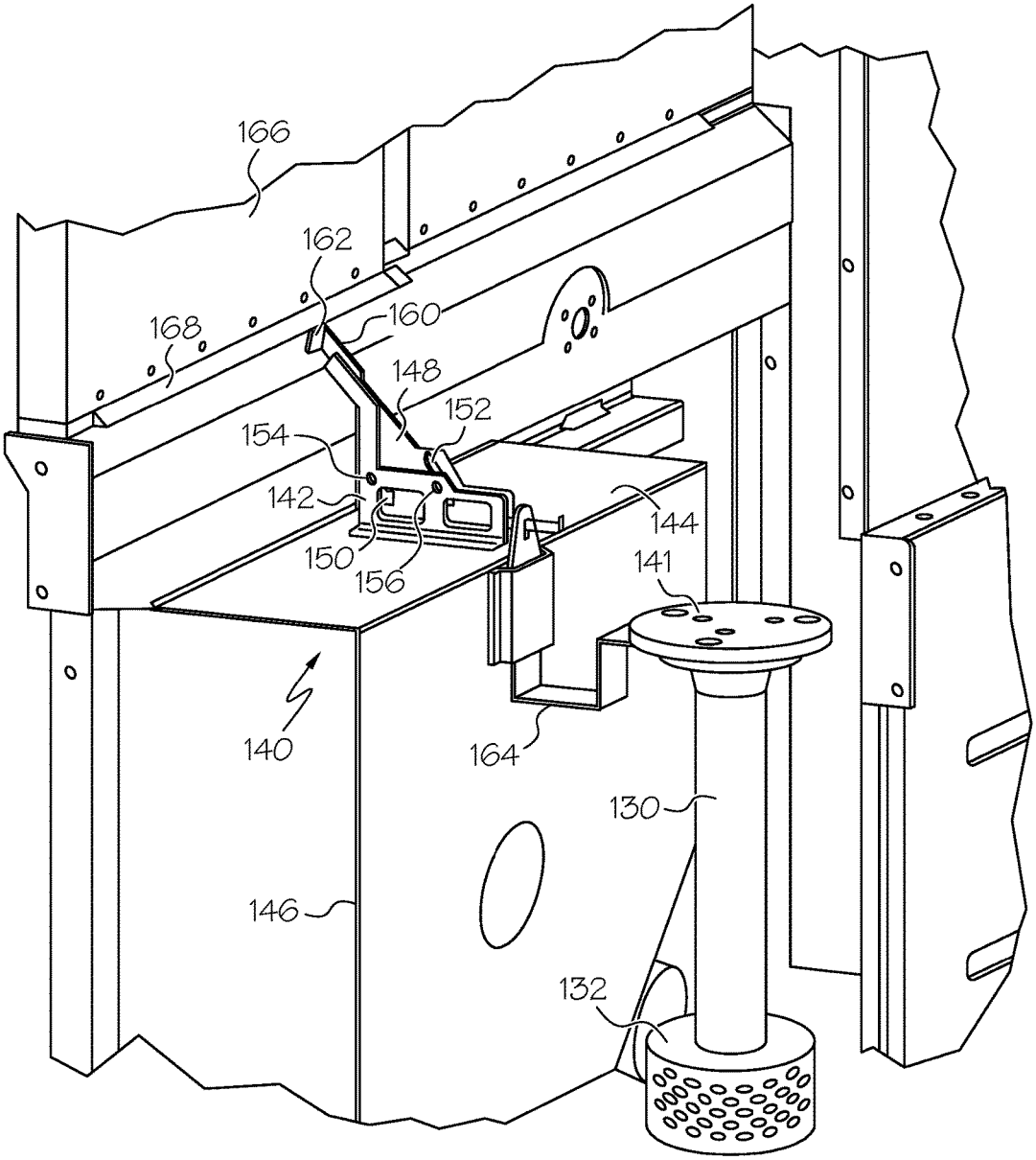
FIG. 2 (PRIOR ART)
FIG. 2 is partial perspective view of a tank drain arrangement.

Referring now to FIG. 2, a drain system for a tank of such machine includes a standpipe 130 that supports a strainer 132 thereon. The standpipe typically sits down in a well and has a lower drain plug portion that can be positioned within the well so as to block a drain port in the well. The drain plug portion may include a tapered end that is used to guide the drain plug portion into the drain port. The standpipe 130 includes an opening at its upper end and passing down through the standpipe to the lower end. A deflector 141 may be included that is connected at the upper end to the standpipe 130. The deflector 141 is spaced from the upper end to allow liquid to pass therebetween during an overflow condition, in which case such overflowing liquid travels down internally within the standpipe to and out of the drain port. The deflector 141 prevents large food particles and tableware (or other objects) from entering the opening of the standpipe.

A drain actuator (here a lift linkage system) 140 is provided for use in lifting and lowering the standpipe 130. The drain actuator 140 includes a support bracket 142 that is mounted on an upper surface 144 of a pump housing 146. The support bracket 142 slidably supports a moveable member 148 that includes a pair of L-shaped slots 150 and 152 within which fasteners 154 and 156 are received. The moveable member 148 includes an engageable end 160 that includes a graspable portion 162 (or lever) that can be grasped and pulled by an operator to lift the moveable member and pull the moveable member toward the operator. Due to the L-shape of the slots 150 and 152, the moveable member 148 can remain in the raised position until a horizontal force is applied thereto. The moveable member 148 is operatively connected to a connector 164 that connects the standpipe 130 to the moveable member. In particular, the connector 164 is illustrated as being releasably engaged with the deflector 141, however, other configurations are possible. Further details are described in U.S. Pat. No. 8,252,121, which is incorporated herein by reference.

Figure 3:
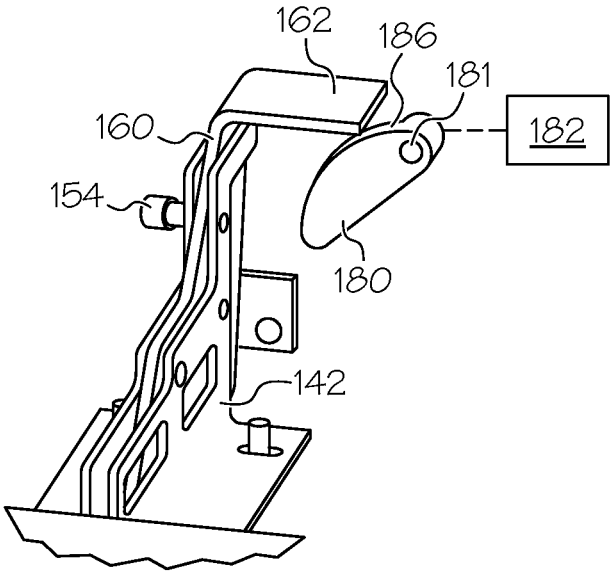
FIGS. 3-5 are partial perspective views of operation of the tank drain arrangement.
Figure 4:
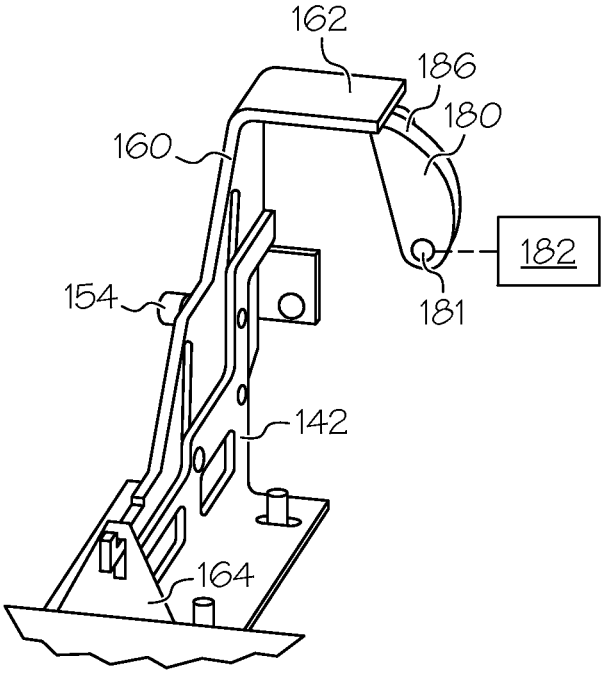
Figure 5:
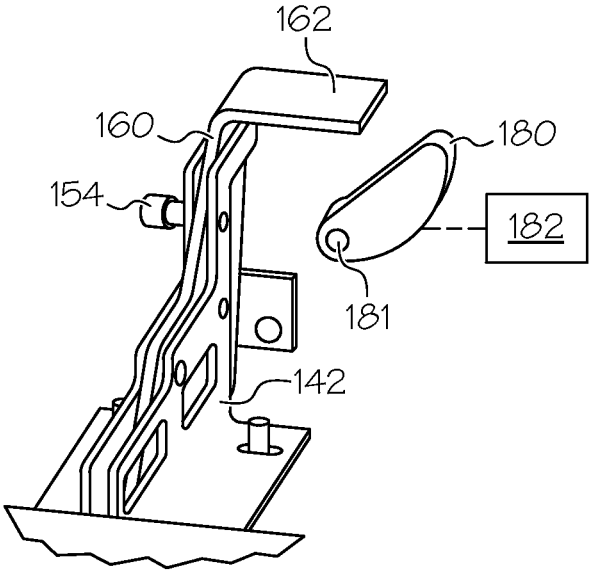

Referring now to FIGS. 3-5, the movement of the movable member of the drain lift linkage may also be controlled by an associated actuator. In this embodiment, a cam member 180 is rotatable by a motor (represented schematically as 182) such as a stepper motor or servo motor. The cam member may be rotatable by a shaft 181 that passes through the machine housing. In FIG. 3 the lever 162 of the movable member 160 is in the lowered position and in FIG. 4 the lever 162 has been moved to the raised position (for draining) by clockwise rotation of the cam member 180, the cam surface 186 of which slides across and relative to the lever 162 as the lever is raised. The cam member 180 is held in the position of FIG. 4 for a time period suited for draining (e.g., a set time period or a time period that ends upon sensing of drain completion), and then the cam member 182 is rotated clockwise to be clear of the lever 162, allowing the lever to release and fall back down (to stop draining) as reflected in FIG. 5. In this regard, the slots 150 and 152 may be shaped to permit such drop without requiring any horizontal shift of member 148.

Figure 6:
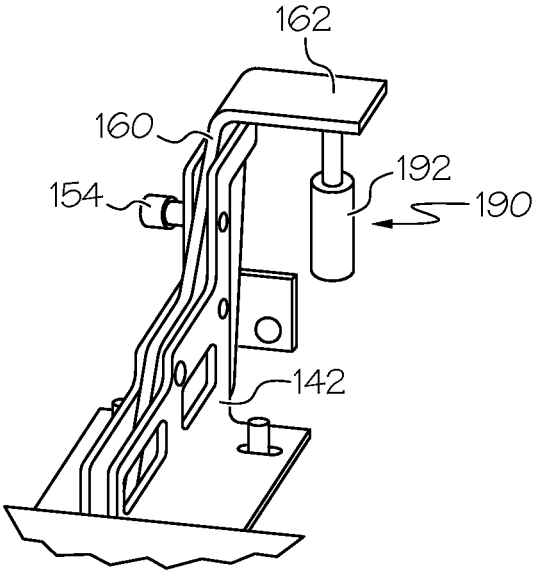
FIG. 6 is a partial perspective view of a variation of the tank drain arrangement.

Of course, it is recognized that other mechanisms could be used to raise and lower the lever 162, such as a solenoid operated device. For example, FIG. 6 depicts a potential arrangement using a linear actuator 190 with associated solenoid 192 to raise and lower the lever 162 of the movable member 160. Notably, in the case of both the cam member arrangement and the linear actuator arrangement, the lever 162 can still be manually moved by an operator of needed.

Through use of these arrangements (e.g., FIGS. 3-5 or FIG. 6), the draining and filling processes of a machine may be automated, providing operators some flexibility to save time by pressing a button for the draining and filling processes to take place in the absence of the operator while the machine gets ready for the next cleaning cycles. Operators are able to perform other tasks while the machine goes through the draining and filling process unmanned, getting the machine ready for the subsequent cycles.

Figure 7:
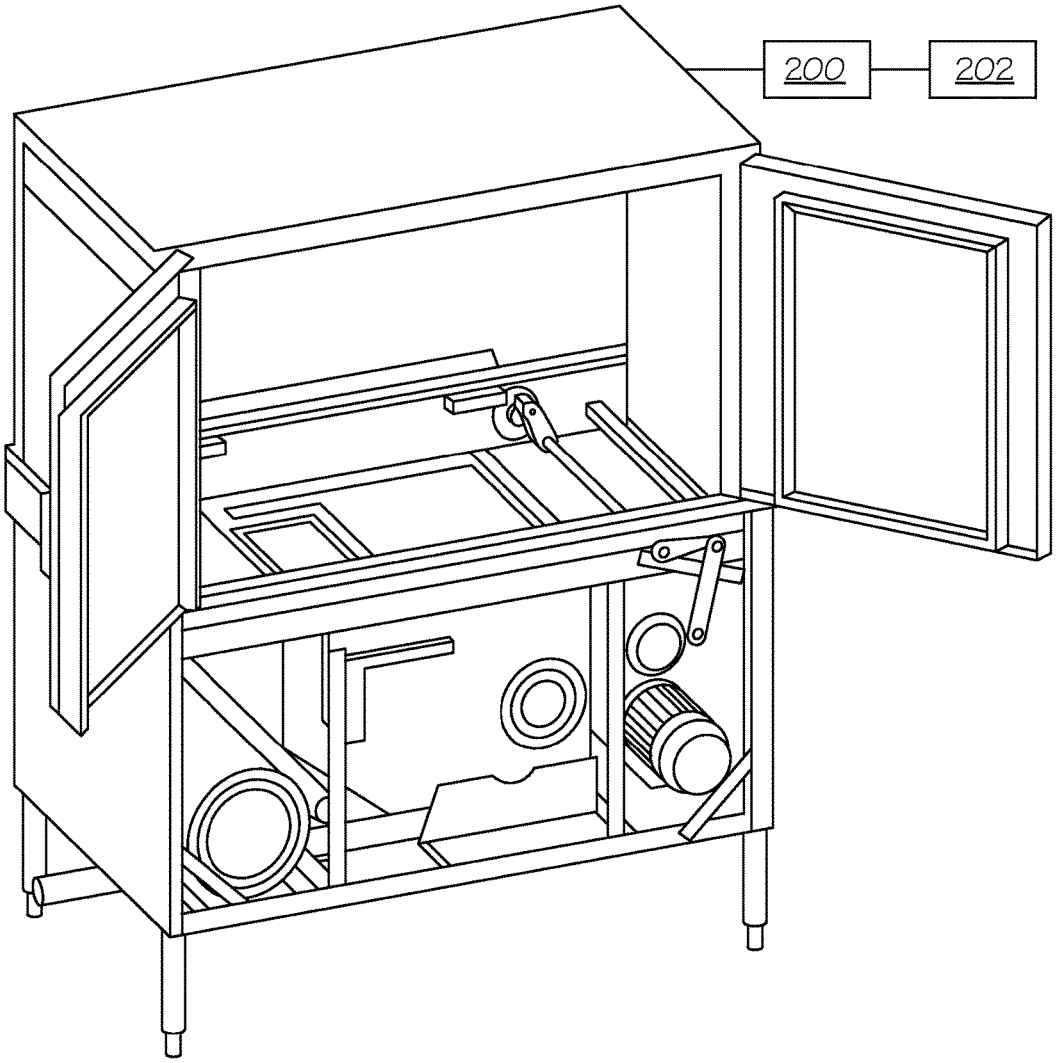
FIG. 7 is a perspective view of another embodiment of a conveyor warewasher.

An exemplary sequence of operation of automatic machine draining and refilling may include an operator pressing a button (e.g., a control button associated with a machine user interface, such as interface 202 depicted in FIG. 7) or taking some other actuation to trigger the drain. The machine controller is configured to control the components in response to the trigger. Thus, the machine controller 200 activates the powered device (e.g., the solenoid 192 or motor 182) to lift the drain lever 162 to an open position (e.g., per FIG. 4) to drain the machine tank. Such lift and drain may, for example, be for a predetermined time period known to be sufficient to allow complete draining. In some embodiments the predetermined time period may be adjustable by the operator (e.g., via the user interface 202), so as to enable either full or partial draining. After the predetermined time period, the powered device finishes its cycle to release or otherwise permit lowering of the drain lever 162 to the closed position (e.g., per FIG. 3), and refill of the machine tank is initiated (e.g., by opening a valve). After refill the machine would then automatically reheat water to a set temperature to make the machine ready for operation.

In one example of a more advanced arrangement, the operator may press the button to trigger drain and refill at any time (e.g., even during an ongoing machine cleaning operation) and the machine will identify (e.g., via controller 200 configuration and use of sensors such as rack detector 64) when the machine is empty of wares. Only then would the controller initiate the automated drain and refill process. In another example of a more advanced arrangement, the controller 200 may keep track of the duration of machine operation since the last drain and refill occurred and initiate an alert (e.g., a drain alert indicator light of the user interface 202) after a predetermined amount of operating time so that the operator knows it may be time to initiate the automated drain and refill.

FIG. 7 shows another machine incorporating the automated drain and fill arrangement, as well as a controller 200' of such machine, and associated user interface 202'.

It is to be clearly understood that the above description is intended by way of illustration and example only, is not intended to be taken by way of limitation, and that other changes and modifications are possible.

What is claimed is:

1. A conveyor warewasher for washing wares, comprising:

at least one spray zone with multiple nozzles for spraying liquid onto wares passing therethrough, the spray zone including a tank for collecting sprayed liquid, the tank including a drain outlet at the bottom of the tank for draining of the tank and a drain stop movable between a drain outlet closed position and a drain outlet open position; and a drain control assembly including a drain actuator operatively connected to cause movement of the drain stop between the drain outlet closed position and the drain outlet open position, wherein the drain actuator is moved by a powered device;

a user interface including a drain and refill trigger button;

a controller including a processor, the controller connected with the user interface, the powered device and a tank refill valve, the controller configured to carry out a tank drain and refill operation in response to a user press of the drain and refill trigger button, wherein the controller is further configured such that during the tank drain and refill operation the following actions take place automatically: the powered device is activated to move the drain stop to the drain outlet open position for a predetermined time period to drain the tank completely, the powered device is thereafter activated to move the drain stop back to the drain outlet closed position, and the tank refill valve is thereafter opened to refill the tank.

2. The conveyor warewasher of claim 1 wherein the powered device comprises a solenoid actuator operatively connected to move the drain actuator.

3. The conveyor warewasher of claim 1 wherein the powered device comprises a motor that rotates a cam member, which in turn engages the drain actuator.

4. A conveyor warewasher for washing wares, comprising:

a housing defining at least one spray zone for spraying liquid onto wares passing therethrough;

a tank for collecting sprayed liquid, the tank including a drain outlet;

a drain stop positioned in the tank and movable between a lowered drain outlet closed position and a raised drain outlet open position, the drain stop including an upwardly extending overflow pipe through which excess liquid in the tank can flow to the drain outlet even when the drain stop is in the lowered drain outlet closed position; and a drain actuator positioned to effect movement of the drain stop between the lowered drain outlet closed position and the raised drain outlet open position;

a powered device to move the drain actuator;

a user interface including a drain and refill trigger button;

a controller including a processor, the controller connected with the user interface, the powered device and a tank refill valve, the controller configured to carry out a tank drain and refill operation in response to a user press of the drain and refill trigger button, wherein the controller is further configured such that during the tank drain and refill operation the following actions take place automatically: the powered device is activated to move the drain stop to the raised drain outlet open position for a predetermined time period to drain the tank completely, the powered device is thereafter activated to move the drain stop back to the lowered drain outlet closed position, and the tank refill valve is thereafter opened to refill the tank.

5. The conveyor warewasher of claim 4 wherein the powered device is a motor that rotates a cam member.

6. The conveyor warewasher of claim 4 wherein the powered device is a solenoid operated linear actuator.

* * * * *